US005697432A

United States Patent [19]

Yun et al.

[11] Patent Number: 5,697,432

[45] Date of Patent: Dec. 16, 1997

[54] STRUCTURE OF HEAT EXCHANGER

[75] Inventors: Jeom Yul Yun; Hyun Young Kim, both of Seoul, Rep. of Korea

[73] Assignee: L G Electronics Inc., Seoul, Rep. of Korea

[21] Appl. No.: 580,956

[22] Filed: Dec. 27, 1995

[30] Foreign Application Priority Data

Dec. 27, 1994 [KR] Rep. of Korea ..... 1994-37528
Feb. 22, 1995 [KR] Rep. of Korea ..... 1995-3431

[51] Int. Cl.[6] ..... F28F 1/32

[52] U.S. Cl. ..... 165/151; 165/DIG. 502; 165/DIG. 503

[58] Field of Search ..... 165/151, DIG. 502, 165/DIG. 503, 182

[56] References Cited

U.S. PATENT DOCUMENTS 4,709,753 12/1987 Reifel ..... 165/125
4,715,437 12/1987 Tanaka et al. ..... 165/151
5,042,576 8/1991 Broadbent ..... 165/151
5,109,919 5/1992 Sakuma et al. ..... 165/151

FOREIGN PATENT DOCUMENTS 2-242092 9/1990 Japan ..... 165/151
4-316992 11/1992 Japan ..... 165/151

*Primary Examiner*—Allen J. Flanigan
*Attorney, Agent, or Firm*—Bell, Boyd & Lloyd

[57] ABSTRACT

A heat exchanger structure is disclosed including: a plurality of heat exchange fins stacked at predetermined intervals for enhanced thermal conduction; heat transfer tubes perpendicularly penetrating the heat exchange fins so that coolant conveyed there through is heated or cooled; an intake side in which a plurality of slits are cut and raised from a reference surface of the fin in a central portion between the heat transfer tubes with angled edges so that air is directed to the heat transfer tube; and an outlet side having raised slits whose edges are disposed at a larger angle than the intake side, increasing the velocity of air flow passing through the periphery of the heat transfer tube to enhance heat exchange and thereby prevent the flow from being stagnated at the rear of the heat transfer tube.

7 Claims, 5 Drawing Sheets

STRUCTURE OF HEAT EXCHANGER

BACKGROUND OF THE INVENTION

The present invention relates to the structure of a heat exchanger for use in an air conditioner, and more particularly, to the structure of a heat exchanger in which a plurality of slits are fabricated on fins placed between heat transfer tubes to maximize boundary layer edge effect and turbulent current mixing effect and make the flow of air smooth, that is, laminar, about heat transfer thereby enhancing the heat transfer performance of the heat exchanger.

FIELD OF THE INVENTION

Generally, as shown in FIG. 1, a conventional heat exchanger consists of a plurality of stacked heat exchange fins 10 at set intervals for heat conduction, and heat transfer tube 20 perpendicularly penetrating heat exchange fin 10 and for heat-exchanging coolant to be carried.

In such a heat exchanger, heat exchange is performed by the conduction of heat from heat transfer tube 20 to heat exchange fin 10 and convection in which heat is transferred to air from heat exchange fin 10.

However, in order to accelerate heat exchange with air in the prior art, as shown in FIGS. 2–5, slits 11 are bent to protude back and forth on heat exchange fin 10.

The number of slits 11 is increased sequentially toward the heat transfer tube from the intermediate portion of both-side heat transfer tubes 20 in zigzag arrangement. See FIG. 2. The slits are provided in X shape at a predetermined angle, producing a smooth flow of air.

The front-line slit portion A and the rear-line slit portion B are different shapes. The height of slits 11 is formed to be half the collar height H of heat exchange fin 10.

In the heat exchanger, heat is conducted from heat transfer tube 20 through which flows high temperature coolant; to heat exchange fin 10. While heat is conducted to heat exchange fin 10 and slits 11, air passes therethrough so that heat is transferred to the air by convection.

In a household air conditioner, the velocity of air induced from the front thereof is 1.5–1.0 m/s so that it is more efficient to increase the amount of air induced, rather than to increase the velocity of air, when air is induced around heat transfer tube 20 after X-shaped slit portions A and B.

Both side walls 11*a* of slits 11 serve as an air fence through which the flow of air around heat transfer tube 20 is made smooth from the flow of air to heat exchange fin 10 due to X-shaped slit portions A and B.

The flow of air induced to the left and right sides of slit portion A is made smooth. However, most of the air flow is induced to the front of slit portion A, further increasing pressure loss due to the collision of air streams.

Due to X-shaped slit portions A and B, the area of the air flow intake induced to heat transfer tube 20 is reduced and thus the amount of air induced is also reduced, which lowers heat transfer function at heat transfer tube 20 which tube performs primary heat exchange.

In X-shaped slit portions A and B, many heat interrupting portions are formed which dissipate the flow of air from cut recesses formed by bending slits 11 which perform primary heat exchange starting from heat transfer tube 20. This weakens conduction for heat exchange. In addition, the increased number of slits 11 raises pressure loss as well as accelerates turbulent flow. As a result, this decreases the performance of the heat exchanger.

SUMMARY OF THE INVENTION

Therefore, it is an object of the present invention to provide a heat exchanger in which the shape and arrangement of slits of the heat exchange fin for a heat exchanger used in an air conditioner are improved to maximize boundary layer edge effects and turbulent current mixing effect and to make the flow of air laminar or smooth, about the heat transfer tubes thereby enhancing the heat transfer performance of the heat exchanger.

To accomplish the object of the present invention, there is provided a structure of a heat exchanger comprising: a plurality of stacked heat exchange fins at every predetermined interval for thermal conduction; a heat transfer tube perpendicular to and penetrating the heat exchange fin so that coolant being conveyed undergoes heat exchange; an intake side in which a plurality of slits are cut and raised at a reference surface of the fin in a central portion between the heat transfer tubes induces more air to the heat transfer tube; and an outlet side having a larger angle than the intake side, increasing the velocity of air flow passing near the periphery of the heat transfer tube to enhance heat exchange and thereby avoiding stagnation of air flow at the rear of the heat transfer tube.

BRIEF DESCRIPTION OF THE ATTACHED DRAWINGS

DETAILED DESCRIPTION OF THE INVENTION

Hereinafter, preferred embodiments of the present invention will be described with reference to the attached drawings.

Figure 1:
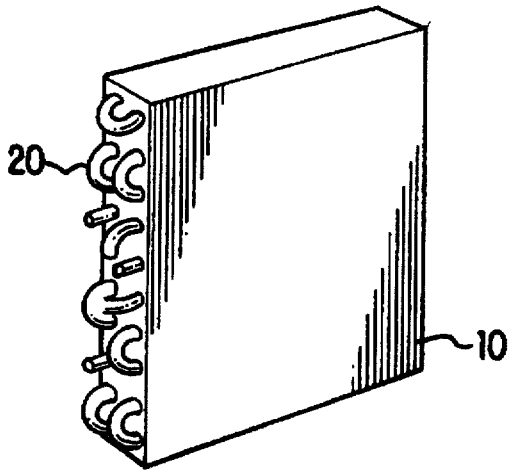
FIG. 1 PRIOR ART
FIG. 1 is a perspective view of a conventional heat exchanger.
Figure 2:
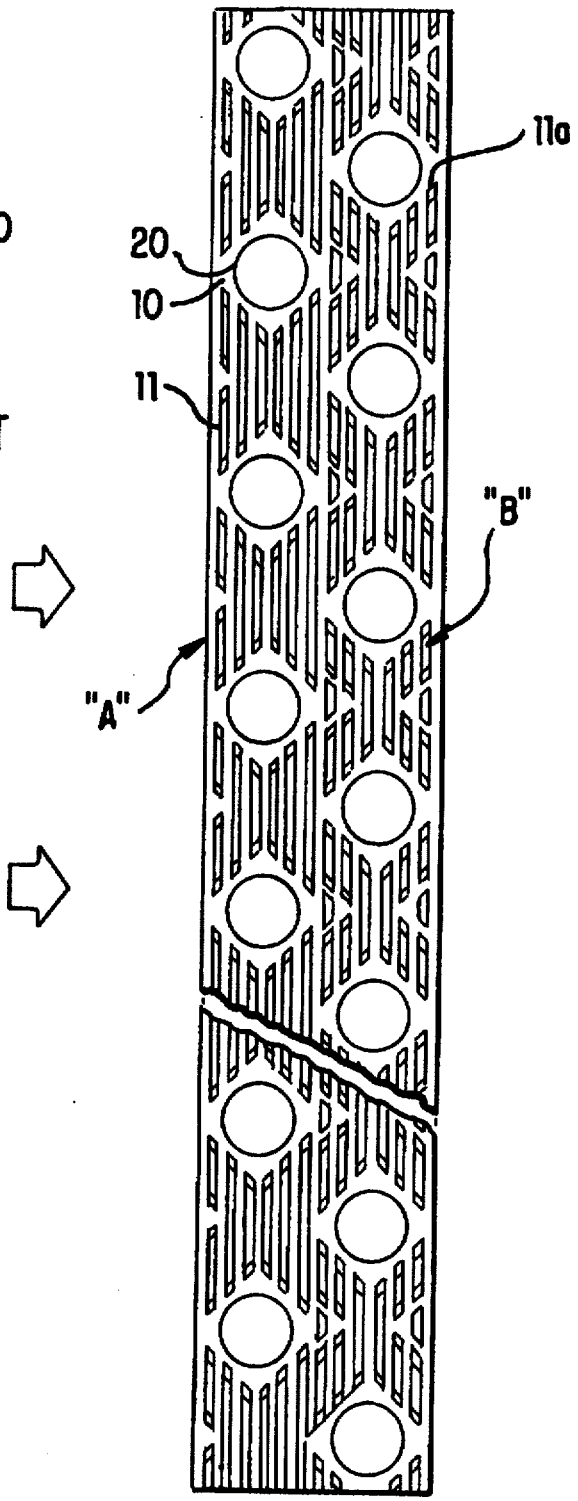
FIG. 2 is a side view of the conventional heat exchanger.
Figure 3:
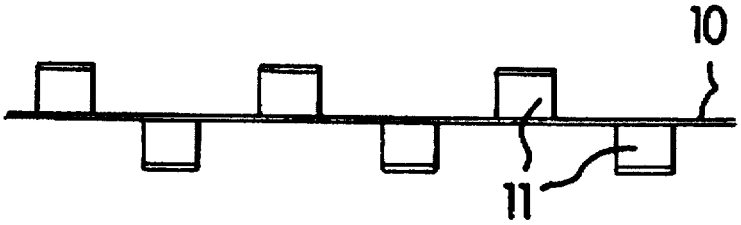
FIG. 3 PRIOR ART
FIG. 3 is a plan sectional view of the slit portion of FIG. 2.
Figure 4:
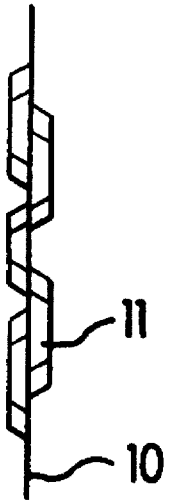
FIG. 4 is a front view of important components of the front line slit portion of FIG. 2.
Figure 5:
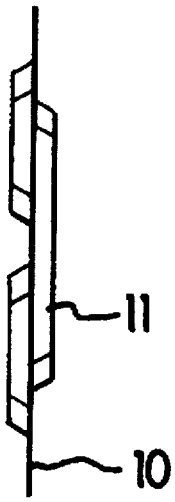
FIG. 5 is a front view of important components of the rear line slit portion of FIG. 2.
Figure 6:
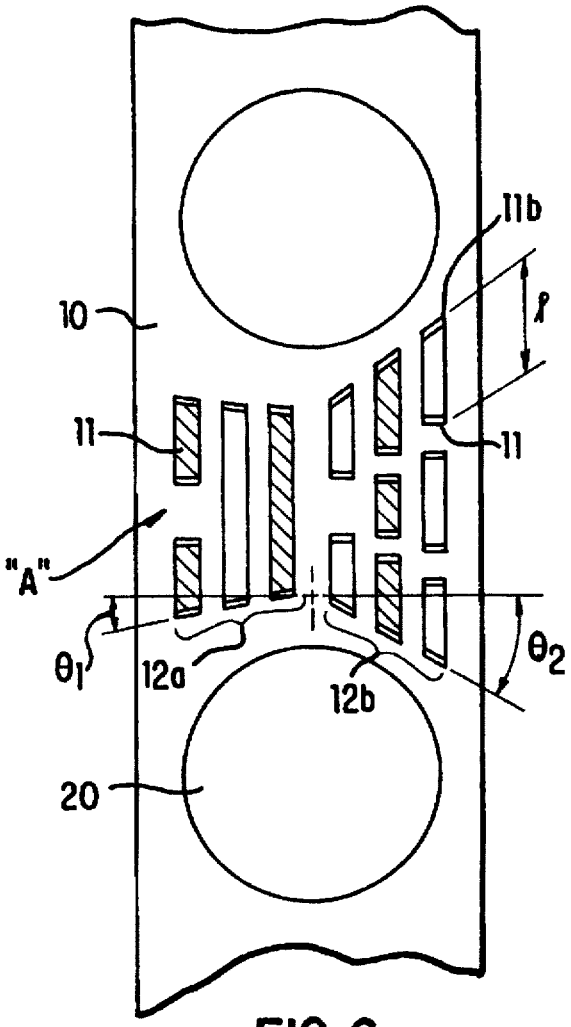
FIG. 6 is a side view of one embodiment of a heat exchanger of the present invention.
Figure 7:
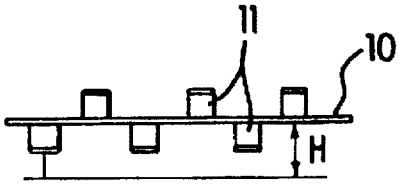
FIG. 7 is a plan view of FIG. 6.

Referring to FIGS. 6 and 7, the first embodiment of a heat exchanger of the present invention comprises a plurality for every heat exchange fins 10 at predetermined intervals for heat conduction, a heat transfer tube 20 perpendicular to and penetrating heat exchange fin 10 so that coolant flowing through the tube is cooled, a protruding intake side 12*a* protrudently formed on heat exchange fin 10 in which a plurality of slits 11 are symmetrically formed in the direction of air flow, centering on an intermediate portion between heat transfer tubes 20 so that air is induced more to heat transfer tube 20, a protruding outlet side 12b formed on heat exchange fin 10 and having a larger angle than intake side 12a so that slits 11 increase the velocity of air flow passing near the periphery of heat transfer tube 20 to enhance heat exchange and thereby avoid stagnation of air flow at the rear of heat transfer tube 20, and an X-shaped slit portion A placed between heat transfer tubes 20.

The angle $\Theta_1$ of intake side 12a is $0° \leqq \Theta \leqq 10°$. The angle $\Theta_2$ of outlet side 12b is $30° \leqq \Theta \leqq 42°$. The protrusion height of slits 11 is ½–⅗ collar height h of heat exchange fin 10. The slits of intake side 12a are arranged in the sequence of 2-1-1, and those of outlet side 12b in the sequence of 2-3-3. Among the slits of outlet side 12b arranged in 2-3-3, both-end slits of the 3—3 arrangement are the same in length l. See FIG. 6. The operation and effect of the present invention will be described below.

High-temperature or low-temperature coolant flowing through heat transfer tube 20 is transmitted to heat exchange fin 10 gradually, centering on heat transfer tube 20, so that heat is transferred in the flow direction of thermal conduction. Here, heat is rapidly and naturally transmitted to slits 11 of protruding slit portion A formed in the flow direction of thermal conduction. This does not interrupt the flow of heat.

The air passing between heat exchange fins 10 stacked at a predetermined interval performs heat exchange by the heat conducted to heat exchange fin 10 and slits 11 and by convection.

The angle $\Theta_1$ of intake side 12a is $0° \leqq \Theta \leqq 10°$ so that air is induced more to heat transfer tube 20. The angle $\Theta_2$ of outlet side 12b is $30° \leqq \Theta \leqq 42°$ so that the speed of air flow passing through the periphery of heat transfer tube 20 is increased to enhance heat exchange and thereby prevent the flow from being stagnated at the rear of heat transfer tube 20.

Specifically, slits 11 are arranged between nearby heat transfer tubes 20 so that intake-side slits are formed in 2-1-1 and outlet-side slits in 2-3-3 from the direction of air flow. This disperses air flow by stages, maximizing the edge effect at boundary layers.

Because the angle $\Theta_1$ of intake side 12a is $0° \leqq \Theta \leqq 10°$ and the angle $\Theta_2$ of outlet side 12b is $30° \leqq \Theta \leqq 42°$, the air flow of intake side 12a is sharply increased and the flow stagnation of outlet side 12b is prevented, thereby increasing thermal transfer efficiency.

Particularly, slits 11 of outlet side 12b are greater than those of intake side 12a so that in case of two line arrangement, the thermal transfer raising effect of two-line heat transfer tubes 20 is maximized. The line connecting the lower line of inner wall 11a of slits 11 and the line connecting the outer wall 11b thereof are formed with the same length so that they are parallel to allow air to flow in the same direction (excluding both side walls) as the air flow induced from the front, maximizing the air induction effect at the two lines.

However, a household heat exchanger has a wind velocity no more than 1.0–1.5 m/s, hardly obtaining the air fence effect of the conventional X-shaped slit portion. In other words, there is a limit in enhancing the speed of air flow to thus increase heat transfer because both side walls of intake-side slits 11 are positioned closest around heat transfer tube 20.

Accordingly, in this invention, both side walls of slits 11 of air intake side 12a are placed farthest, increasing the amount of air coming into direct contact with heat transfer tube 20, a heat source, rather than enhancing the velocity of induced air flow. This is the primary heat transfer. Secondly, the angle of both side walls of slits of outlet side 12b is set to be larger to narrow the distance between heat transfer tube 20 and the side walls. This increases the velocity of air flow, preventing air flow from being stagnated at outlet side 12b of heat transfer tube 20. In other words, more air is induced through intake 12a, and the velocity of air is increased at outlet side 12b, enhancing the heat exchange efficiency from heat transfer tube 20.

The air is fed to heat transfer tube 20 through intake side 12a and outlet side 12b of slits 11 so that the primary heat exchange with heat transfer tube 20 is maximized. The air flow is smoothly taken along side walls 11a of slits 11, reducing pressure loss.

Due to edge effect and turbulent current effect of slits 11, the convection transfer effect to heat exchange fin 10 is transmitted to heat transfer tube 20 thereafter, increasing heat exchange efficiency.

The air flow surrounds heat transfer tube 20 by outlet side 12b of slits 11 so that the stagnation of air flow which may take place at the rear of heat transfer tube 20 can be prevented. The shape of slits installed at the intermediate position maximizes the edge effect.

In addition, because the velocity of wind is 1.0–1.4 m/s, air induced perpendicular to the front occupies most of the amount of air, and the side walls of slits 11 of the intermediate portion of the 3—3 arrangement of outlet-side slits 11 are installed perpendicular to the direction of air flow, in case of two-line alternate arrangement of heat transfer tube 20, the rear line of the heat transfer tube may directly receive the secondary air.

At intake side 12a, fewer slits are provided, at outlet side 12b, more slits are provided, enhancing turbulent current mixing effects and edge effects.

In the prior art, the height of slits 11 is half the fin collar height h. However, in the present invention, in order to maximize the air fence effect, the height of the slits is ½–⅗h of the collar height so that air may smoothly flow around the heat transfer tube.

Figure 8:
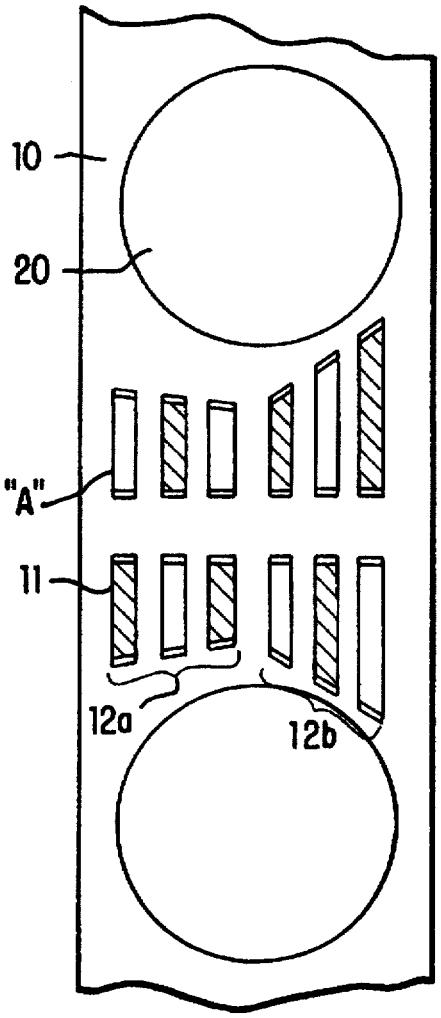
FIG. 8 is a side view of another embodiment of the heat exchanger of the present invention.
Figure 9:
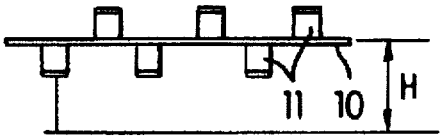
FIG. 9 is a sectional view of FIG. 8 cut along line A—A.
Figure 10:
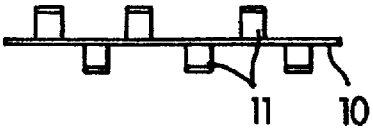
FIG. 10 is a sectional view of FIG. 8 cut along line B—B.

Referring to FIGS. 8, 9 and 10, the angle $\Theta_1$ of intake side 12a and the angle $\Theta_2$ of outlet side 12b are the same as in the first embodiment. The heat exchange fin 10 is divided in two centering on the intermediate portion of nearby heat transfer tubes 20. Slits 11 formed on both sides of heat exchange fin 10 are alternately arranged to maximize the turbulent current mixing effect. The distance between slits 11 is maintained constant, maximizing the conduction effect.

The air flow moving along heat exchange fin 10 without change can be in direct contact with alternately arranged two-line heat transfer tubes 20, contributing to the increase of the two-line exchange effect.

As discussed above, the side walls of the intake-side are installed farthest from the periphery of the heat transfer tubes and thus the amount of air in direct contact with the heat transfer tube is sharply increased to perform the first heat transfer. The installation angle of the side walls of the outlet side is set to be larger to generate flow and thus prevent the increased air flow from being stagnated at the rear of the heat transfer tube. More slits are installed toward the outlet side, maximizing the turbulent current mixing effect and edge effect. The arrangement of slits is provided to smooth the air flow, reducing the flow resistance of the air flow and pressure loss as well.

Figure 11A:
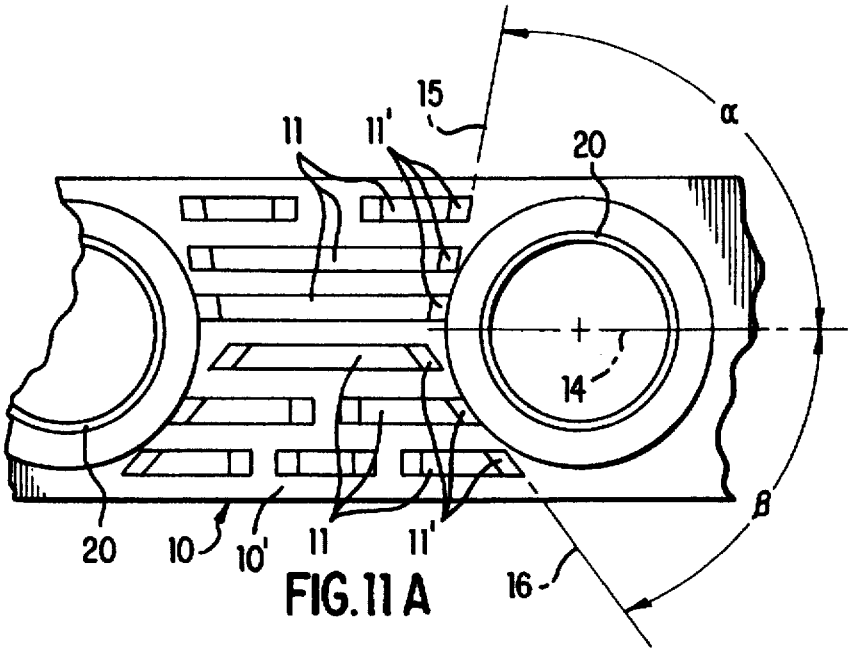
FIGS. 11A and 11B are plan and side views of still another embodiment of the heat exchanger of the present invention, respectively.
Figure 11B:
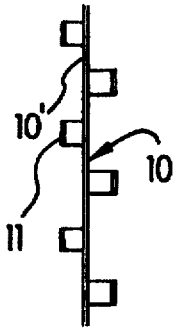
Figure 12:
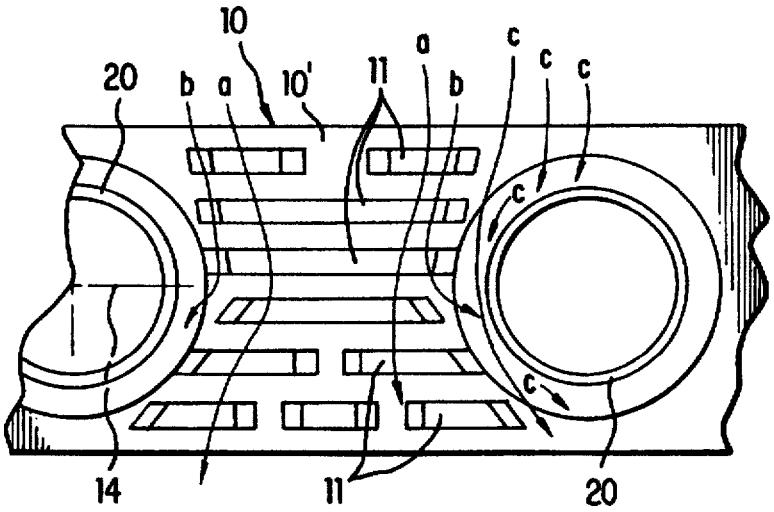
FIG. 12 illustrates the flow of air at the fins of the heat exchanger of the present invention.

Referring to FIGS. 11A, 11B and 12, the angle $\alpha$ between slit side walls 11' of the intake side and the center line 14 of the heat transfer tube becomes larger to maximize the convection effect to heat transfer tube 20. The angle $\beta$ between the slit side walls of the outlet side becomes smaller to suppress vortex current which may be produced at the rear of the tube. As a result, this eliminates a current stagnation area.

Given a concentric circle having a slightly greater radius than that of the heat transfer tube around heat transfer tube 20, the side walls of the second slit of the intake side and the second slit of the outlet side are set to become the same as the tangent lines 15 and 16 of the circle. Extending those tangent lines, other slits are formed.

For the angle between tangent lines 15 and 16 and center line 14, the upper line 15 is 70°–85°, and the tangent line 16 of the outlet side is 40°–50°. The intake side has fewer slits than the outlet side in order to reduce pressure fall. The first slit of the intake side is formed in a two-divided body. Other slits are formed as single.

The slits of the outlet side are formed in 1-2-3 divided bodies according to the travelling direction of wind in order to make the velocity of the rear flow uniform. Heat exchange fin 10 has a plurality of slits 11. The slits of the intake side and outlet side formed on fin base 10' are asymmetrical, centering on center line 14 connecting the center of heat transfer tubes 20.

The side walls 11' of the intake-side slits 11 are formed so that the side walls of the third slit adjacent to heat transfer tube 20 is the same as a tangent line 15 of a circle drawn greater than the concentric circle of heat transfer tube 20. The side walls 11' of the outlet-side slits 11 are formed so that the side walls of the second slit adjacent to heat transfer tube 20 is the same as a tangent line 16 of a concentric circle. The outlet-side slits provided are fewer than the intake-side slits.

The angle α between tangent line 15 forming the side walls 11' of intake-side slits 11 and center line 104 is 70°–85°. The angle β between tangent line 16 forming the side walls 11' of outlet-side slits 11 and center line 104 is 40°–50°.

Intake-side slits 11 are formed as single slit excluding the first two-divided slit. The outlet-side slits are divided more in the direction of the air flow.

The central portion of slits 11 is right-angled to produce smooth flow of air induced, thereby reducing pressure loss. The side walls have a predetermined angle so that air induced smoothly performs heat exchange with the heat transfer tube.

Slits 11 are installed erect on the fin base at 38°–45° of side wall 11' on heat transfer tube 20. At its center, the erect angle of side walls 11' is 30°–35°.

As shown in FIG. 12, the side walls of the first slits are formed by extending a tangent line of a circle drawn on the periphery of the tube centering on the central slit side walls of the outlet side, at the reference of center line 14 connecting heat transfer tube 20, producing an air flow "b" with which air flow "a" runs toward the outlet side to meet air flow "c".

With the conduction through the fin surface and installation of the side walls of the outlet side, heat produced from heat exchange fin 10 moves to heat transfer tube 20, doubling the air flow mixing effect.

Unlike the fact that the side walls of the slits around heat transfer tube 20 maintains the predetermined angle, the side walls of the center are formed linearly with the direction of air flow, reducing pressure loss caused when they are formed at a slant angle.

The slits of the outlet side are divided to maximize the noise reduction effect. The side walls of the central slits are formed in the direction of the air flow, further reducing pressure loss. This contributes to lower noise for the heat exchanger.

The angle β between the linear side walls of the slits and fin base is 38°–45°, increasing producibility (in considering elongation of the aluminum plate). The angle of the linear side walls of the slits is reduced to enable smooth falling of condensed water which may be produced at the fins.

As described above, in the present invention, the mixing effect of air flow is enhanced as compared with prior art and thus the convection heat transfer effect is doubled. In addition, noise due to inconsistency of the air flow velocity is reduced. Further, discharge of condensed water is made smooth, and pressure loss is sharply reduced.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

What is claimed is:

1. A heat exchanger comprising:

a plurality of stacked heat exchange fins at predetermined intervals for thermal conduction;

a heat transfer tube perpendicularly penetrating said heat exchange fins so that coolant conveyed through heat transfer tubes is cooled;

an intake side and an outlet side in which a plurality of slits are cut and raised at a reference surface of the fin in a central portion between said heat transfer tubes so that air is directed to said heat transfer tubes; inlet side slits with side walls angled relative to the perpendicular to the tube axis plane at a first acute, non-zero angle, outlet slits with side walls aligned along a second acute angle relative to the perpendicular greater than the first acute angle, with the side walls of a given slit angled oppositely, thereby increasing the air flow velocity passing through the periphery of said heat transfer tube to enhance heat exchange, wherein the first acute angle of said intake side is between 5° and 10°, and the second acute angle of said outlet side is between 30° and 42°, and avoid stagnation of air flow to the rear of the heat transfer tubes.

2. A heat exchanger as claimed in claim 1, wherein a protrusion height of said slits is ½–⅗ a collar height of said heat exchange fin.

3. A heat exchanger as claimed in claim 1, wherein three rows of slits of said intake side are arranged in the sequence with the outermost slit split and the next two innermost slits being continuous, and those of said outlet side in the sequence with the outermost slits being divided into thirds and the innermost slit being split into two parts, centering on a center line between heat exchange tubes whereby the slits are arranged in the sequence of 2-1-1-2-3-3 from the direction of air flow.

4. A heat exchanger as claimed in claim 1, wherein the slits are arranged symmetrically above and below heat exchange fins, centering on the intermediate portion between heat exchange tubes.

5. A heat exchanger as claimed in claim 3, wherein the two innermost slits arranged in a outlet side sequence are the same in length.

6. A heat exchanger as claimed in claim 3, wherein the slits of said outlet side are arranged in a sequence with the outermost slit whole, and the innermost next slits are split and divided in thirds, respectively, centered on a center line between heat exchange tubes.

7. A heat exchanger as claimed in claim 3, wherein an angle of a tangent line, which is formed with the side walls of said intake-side slits and heat transfer tube and a concentric circle, with a center line connecting the tubes is 70°–85°.

* * * * *